United States Patent [19]

Wallis, Jr. et al.

[11] 4,195,606

[45] Apr. 1, 1980

[54] METHOD AND APPARATUS FOR TREATING AIR FOR INTERNAL COMBUSTION ENGINES

[76] Inventors: Thomas F. Wallis, Jr., 5623 Boaz St., Apt. 91, Dallas; Asa M. Pearson, 4117 Lovers La., University Park, both of Tex. 75209; Robert C. Wallis, 1074 Hartford Turnpike, North Haven, Conn. 06473

[21] Appl. No.: 852,080

[22] Filed: Nov. 17, 1977

[51] Int. Cl.[2] ..... F02M 7/00

[52] U.S. Cl. ..... 123/119 E; 123/1 R; 60/274; 60/275

[58] Field of Search ..... 123/119 E, 1; 60/274, 60/275

[56] References Cited

U.S. PATENT DOCUMENTS

| | | | |
|---|---|---|---|
| 1,145,140 | 7/1915 | Henri et al. | 123/119 E |
| 1,529,351 | 3/1925 | Grooms | 123/119 E |
| 1,627,938 | 5/1927 | Tingley | 123/119 E |
| 1,727,919 | 9/1929 | Weckerle | 123/119 E |
| 2,960,975 | 11/1960 | Bergstrom | 123/119 E |
| 3,976,448 | 8/1976 | Eng et al. | 123/119 B |
| 4,043,308 | 8/1977 | Cerkanowicz | 123/143 R |

FOREIGN PATENT DOCUMENTS

| | | | |
|---|---|---|---|
| 673253 | 10/1963 | Canada | 123/119 E |
| 1285249 | 12/1968 | Fed. Rep. of Germany | 123/119 E |
| 269808 | 4/1927 | United Kingdom | 123/119 E |

*Primary Examiner*—Wendell E. Burns

*Attorney, Agent, or Firm*—DeLio and Montgomery

[57] ABSTRACT

Combustion air for an internal combustion engine is treated to activate the oxygen molecules prior to mixing with the fuel. The oxygen is photochemically activated by ultraviolet radiation.

9 Claims, 9 Drawing Figures

METHOD AND APPARATUS FOR TREATING AIR FOR INTERNAL COMBUSTION ENGINES

This invention relates to internal combustion engines, and more particularly relates to treatment of the combustion air therefor.

In internal combustion engines, oxygen required for combustion of fuels is taken into the engines in its naturally occurring molecular form. Air containing the oxygen is mixed with vaporized fuel and ionization of the oxygen necessary for the oxidation-reduction reaction of combustion is initiated in the cylinders of the engine by electric spark or in the diesel engine by heat of compression, prior to combustion.

In either type of engine, the chemical properties of the fuels, low flash point, high volatility and low ionizing temperature, permit the fuel molecules to ionize with less heat than is required for the ionization of oxygen. If the oxygen in the combustion air could be made to ionize at a lower temperature, combustion could take place at a lower temperature. This would contribute to lessening of exhaust pollutants, and substantially increased fuel economy.

It previously has been proposed to ionize a fuel mixture by subjecting the mixture to an electrostatic field (U.S. Pat. No. 1,771,626). However, the electrostatic fields break down in damp or humid weather. It has further been proposed to aid the process of ignition by subjecting the combustion zone to ultraviolet radiation while creating ozone in the fuel-air mixture (U.S. Pat. No. 1,727,919). This process is not practical due to very specialized engine construction, and locating the ultraviolet source in the manifold. The heat of the manifold is inimical to the operation of ultraviolet lamps. Moreover, location of the ultraviolet source in the manifold makes service or replacement thereof very difficult.

We have discovered that the combustion process may be improved with resultant increase in fuel economy and decrease in the level of exhaust pollutants by treatment of the combustion air to activate or excite the oxygen molecules prior to mixing with the fuel. It is postulated that activating or exciting the oxygen molecules enables ionization of the oxygen at a lower temperature, thus producing more complete combustion at a lower temperature and with a more even burn wave. This decreases the amount of unburned hydrocarbons and lowers the exhaust pollutants, as well as contributing to fuel economy.

Briefly stated, the oxygen in the air is photochemically activated or excited by being subjected to ultraviolet radiation prior to being mixed with the fuel. The ultraviolet (UV) radiation is selected to be substantially in the 2537 A° region, which is in approximately the strongest absorption region of oxygen. According to theory (*The Chemical Action of Ultraviolet Rays,* Ellis and Wells, 1941, Reinhold Publishing Corporation, Revised by Francis F. Heysoth), the energy of the UV photons is absorbed by the electrons in the valence rings, thereby activating or exciting the oxygen molecules.

Regardless of the accuracy of the stated theory and postulation, significant results have been obtained in increased fuel efficiency and decrease in exhaust pollutants through practice of the invention.

Tests have shown a large increase of fuel efficiency in the form of more miles per gallon of gasoline consumed, together with a significant reduction in the amount of carbon monoxide and unburned hydrocarbons in the automobile engine exhaust.

An object of this invention is to provide a new and improved method and apparatus for treating the combustion air of internal combustion engines to improve the fuel efficiency thereof.

Another object of this invention is to provide a new and improved method and apparatus for treating the combustion air of internal combustion engines to reduce pollutants in the engine exhaust.

The features of the invention which are believed to be novel are particularly pointed out and distinctly claimed in the concluding portion of this specification. The invention, however, both as to its operation and organization together with further objects and advantages thereof may best be appreciated by reference to the following detailed description taken in conjunction with the drawings wherein:

Figure 1:
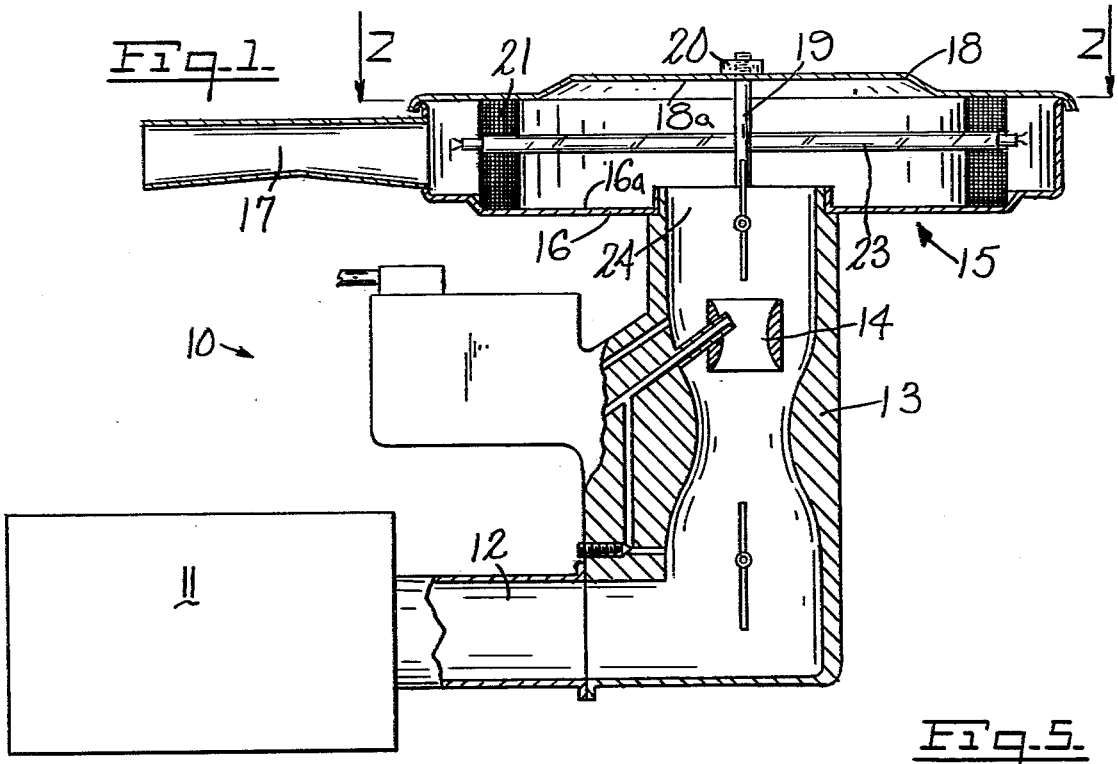
FIG. 1 is a side elevation representation of an internal combustion engine of the ignition type having an air cleaner housing.

FIG. 1 exemplifies an internal combustion engine 10 to which the invention may be applied. The engine 10 as shown is an automobile engine and comprises a main cylinder block 11 which receives a fuel-air mixture via manifold 12 through a carburetor 13. The combustion air is mixed with the fuel in a venturi 14. Supported at the top of carburetor 13 is an air cleaner housing 15 comprising a lower annular pan 16, an air scoop 17, and a removable cover member 18. Cover member 18 is generally secured to the housing by means of a stud 19 receiving a hold down nut 20 thereon.

Disposed within housing 15 is the conventional annular air filter 21.

Figure 2:
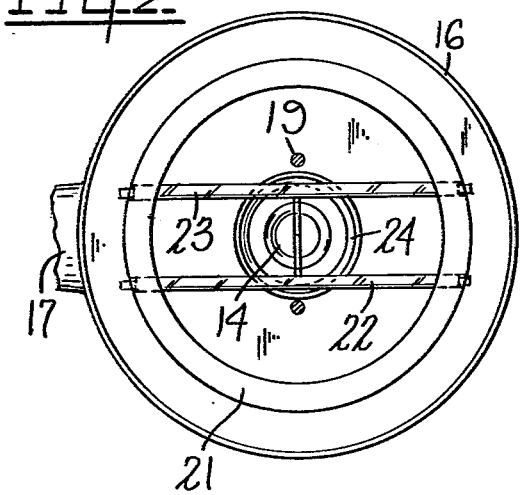
FIG. 2 is a plan view of the air cleaner housing of FIG. 1 with the cover removed.

In accordance with the invention, a source of UV light is disposed in the air cleaner housing. In the form shown in FIGS. 1 and 2 are two tubular lamps 22 and 23.

Preferably, the lamps 22 and 23 are positioned so as to be close to and at least partially overlie the barrel 24 of the carburetor. This is to be sure that the air entering the carburetor is exposed to the most intense UV radiation. The UV field is strongest close to the lamp. The lower surface 16*a* of housing 15 is preferably provided with a reflective coating while the undersurface 18*a* of cover 18 is also provided with a reflective surface or covering. A separate reflector, not shown, may also be provided. This will enhance the treatment of the air in housing 15 by greater exposure to the UV radiation. Preferably, the reflector is formed or positioned to reflect the UV radiation toward the barrel of the carburetor to maximize exposure of the combustion air to the UV radiation.

Figure 3:
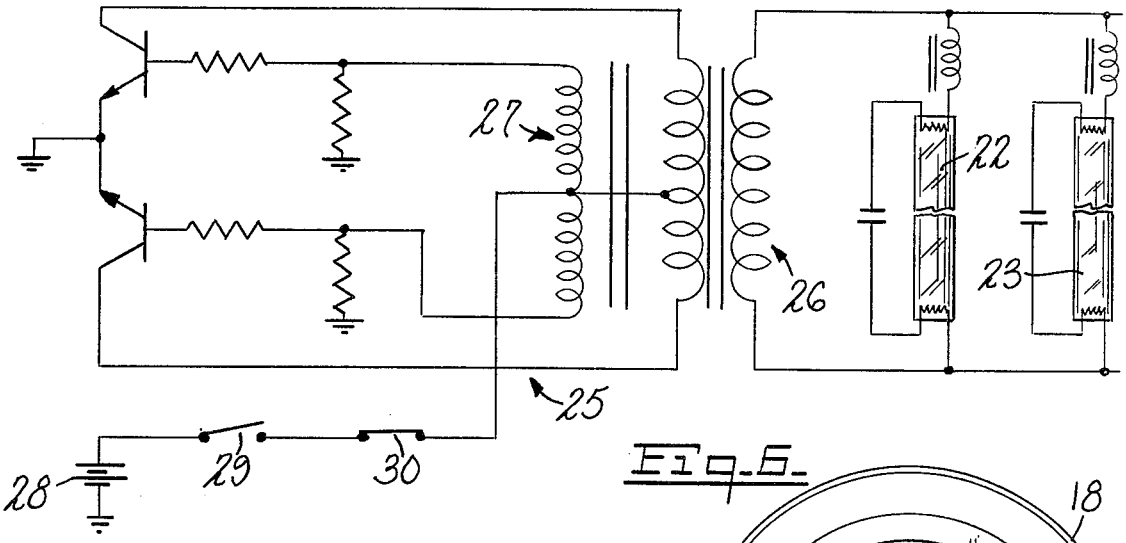
FIG. 3 is a schematic diagram of an inverter connected to two UV tubes which may be used in operation of the invention.

The power source (FIG. 3) for the ultraviolet lamps in one form may be an inverter 25 of conventional form which inverts the usual twelve volt direct current of the automobile battery or the output of the voltage regulator to an alternating potential. The greater the frequency of excitation by the inverter, the greater the intensity of the UV energy in a given period of time. As shown in FIG. 3, the secondary 26 of transformer 27 is connected across the lamps 22 and 23 to provide the electrical excitation therefor. The lamps may also be connected in series. The inverter 25 is energized from the battery 28 or from the output of the voltage regulator (not shown) through the ignition switch 29 and also a safety switch 30 which opens a circuit to the inverter should the lid 18 of the air cleaner housing be removed.

The UV lamps 22 and 23 may be of the G8T5 type. Such lamps are 12 inches long and are rated at 8 watts.

By placing a portion of the ultraviolet lamps over the carburetor barrels and also making the interior surfaces of the housing reflective, maximum exposure of the incoming combustion air to the UV radiation is obtained from the standpoint of time and intensity prior to mixing with the fuel and also from the standpoint of the radiation due to the reflection.

The wavelength of the UV energy is substantially in the range of 1800 to 3000 A°, and predominantly about 2537 A°. Available UV lamps will also produce radiation at shorter wavelengths. However, radiation in the 2000°-3000 A° range is preferred. It is believed that the UV photons give energy to the valence electrons in the $O_2$ molecules and thus excite or activate the oxygen molecules in activated oxygen. It is postulated that the $O_2$ molecule excited by a photon in the 2500 A° range results in activated oxygen ($O_2$). A photon of about 1847 A°, if present, may excite the other binding electron to an ionized state ($O^{--}$). Some $O_2$ will also be present if the oxygen in the combustion air is not totally activated. Then the $O^-$ would ignite first at the lowest temperature in the cylinders, then the $O^{--}$ and finally the $O_2$ at the highest temperatures. Most of the oxygen will be in the $O_2$ state. This permits the oxygen to ionize in the combustion process at a lower temperature and provide more complete combustion in the cylinders. In any event, use of the invention substantially enhances the combustion process as hereinafter exemplified.

Figure 4:
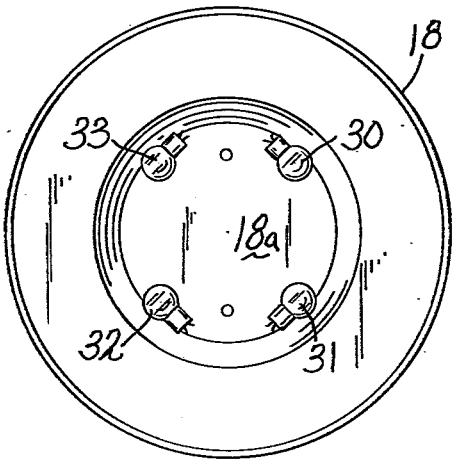

FIG. 4 exemplifies another arrangement of the UV radiation source wherein four bulb-type lamps 30–33 are mounted to the inside surface 18a of air cleaner cover 18. The lamps 30–33 may be of the General Electric G4S11 type, which are rated at four watts each.

Figure 5:
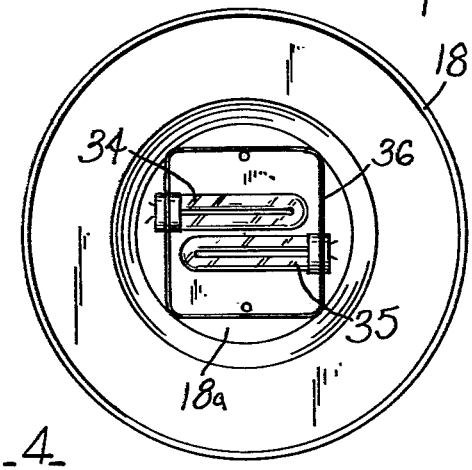
FIGS. 4 and 5 are views of the underside of a cover of an air cleaner housing showing the manner in which ultraviolet lamps may be mounted thereto.

FIG. 5 exemplifies another arrangement where UV lamps 34 and 35 of the folded or bent tube type are supported on the underside 18*a* of cover 18. Lamps 34 and 35 are mounted within a housing 36 which is attached to surface 18*a*.

Figure 6:
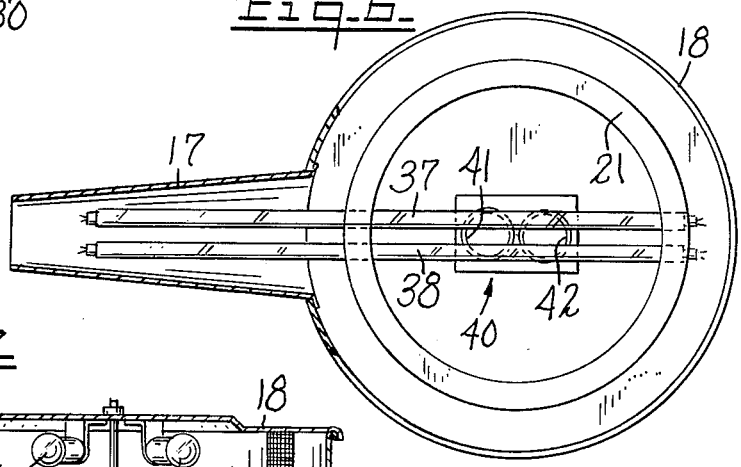
FIG. 6 is a plan view of an automobile air intake housing exemplifying another embodiment of the invention.

FIG. 6 exemplifies another arrangement where UV lamps 37 and 38 of the tube type are chosen to extend into air scoop and treat the incoming air prior to the air cleaner. This increases the time of treatment of the air to the UV energy. FIG. 6 exemplifies a carburetor 40 having two barrels 41 and 42. The lamps are positioned over the barrels to maximize the UV radiation in the air entering the carburetor barrels and thus effect actiation or excitement of substantially all of the oxygen in the combustion air.

Figure 7:
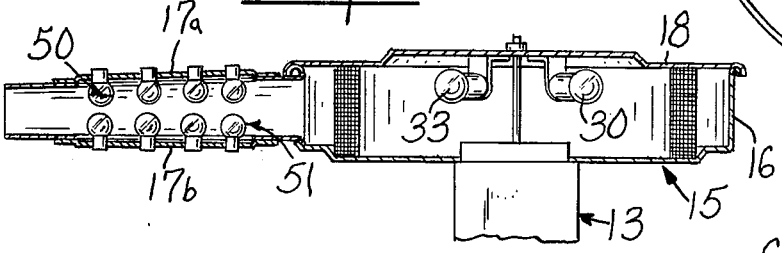
FIG. 7 is a side view of an automobile air intake housing exemplifying another embodiment of the invention.
Figure 9:
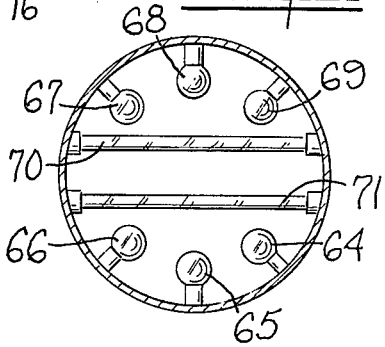
FIG. 9 is a view seen in the plane of lines 9—9 of FIG. 8.

FIG. 7 exemplifies a similar arrangement to that shown in FIG. 4, and also provides for treatment of the air in air scoop. Removable carrier plates 17*a* and 17*b* each carry sockets for a plurality of UV lamps 50 and 51, respectively. The bulbs 30–33 are mounted within the air cleaner in housing 18, as previously exemplified in FIG. 4.

Figure 8:
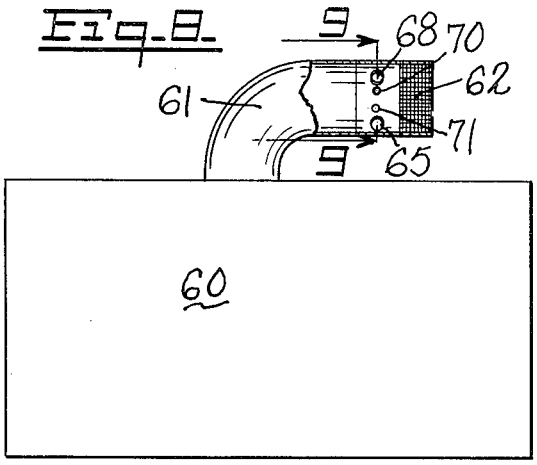
FIG. 8 is a view representing a side elevation of a diesel engine.

The invention may also be used in diesel engines. A diesel engine 60 having an air intake housing 61 is exemplified in FIG. 8. Housing 61 includes a filter 62. Disposed in housing 61 behind filter 62 but prior to mixing of the air with the fuel is a fixture 63, carrying a plurality of UV lamps, 64–71 which may be of both tubular and bulb form.

Among the presently available UV lamps, the low pressure mercury vapor lamps of both hot and cold cathode type, designed for germicidal applications, have been found preferable. These lamps are designed for maximum energy output in the 2537 A° wavelength. About sixty percent of the input energy is transformed to this wavelength. About three quarters of this is transmitted through the glass, thus about half of the input energy is transformed into energy of the preferred wavelength. Other wavelengths are also present.

As previously stated, the UV lamps should be placed to direct as much radiation as possible into or about the barrel(s) of the carburetor to treat a maximum of oxygen molecules entering the carburetor prior to mixing with fuel.

Practice of the invention has provided increased gas mileage for automobiles, reduction of carbon monoxide and unburned hydrocarbons in the engine exhaust, as well as other aromatic pollutants as may be appreciated by the following examples.

EXAMPLE I

In a test on a 1973 Ford LTD sedan having an engine rated at 351 cubic inches, two General Electric G8T5 lamps which are 8 watt, 12 inch tubes, were energized from the inverter of the type shown in FIG. 3. The arrangement of the lamps was as shown in FIG. 2, and required about 2.5 amperes of current from the direct current electrical system of the automobile. The output of the inverter across the tubes was fifty volts. Comparative tests showed an average fuel use of 17.6 miles per gallon with treatment of the combustion air in the aforementioned manner and an average of 10.7 miles per gallon without the treatment.

The road testing was conducted first by making controlled test runs on an established course of driving without the means for treating the combustion air, and the miles per gallon were computed for comparison with test runs when the air treating device was attached and operating. In the conduct of both the controlled tests and the experimental tests, a variety of factors were considered to limit any error. The tests were made over a period of January to July, 1977. The controlled test totalled 2524 miles while the experimental tests covered 2512 miles. Frequently, checks were made to assure that tire pressure remained the same, the same driving habits were maintained, and the same passenger loads were maintained. Test runs were conducted at the same time of the day on days when traffic conditions were approximately equal. However, to determine possible variables that might affect the efficiency of the tests, both controlled test runs with the treatment inactive and experimental runs with the treatment active were conducted over a wide range with weather conditions that included unusually severe winter conditions in January and February, moderate temperatures and weather conditions in March, April and May and warm weather conditions in June and July. The range of tests included ambient temperatures from −8° F. to 100° F. and relative humidities of up to 100%. In the course of the road testing, plugs, points and air filters were changed and at the time a change was made the experimental device was turned off and controlled runs conducted to determine a new base line of miles per gallon, for comparison with later experimental runs.

Low test, leaded gasoline was utilized in both the controlled and experimental runs. During the experimental runs, the spark plugs were replaced or cleaned at the beginning of each series of tests that followed controlled runs. This was because one of the beneficial results of the invention is prevention of fouling of the plugs, and carryover of fouled plugs from the controlled runs to the experimental runs detracts from the increase in miles per gallon in use of the invention. During both the controlled and experimental runs, the air-fuel mixture was the same. Gasoline was added only at self-service pumps so that the inlet pipe to the gasoline tank was completely filled, thus reducing gasoline measurement error to less than 0.1%. The cars tested were equipped with standard double belted nylon tires. During controlled tests and experimental tests, driving speeds did not exceed 50 miles per hour, were always conducted between 2 P.M. and 5 P.M. on a driving course composed of approximately one-fourth city streets in traffic, one-fourth country roads, and one-half of limited access, plural-lane highway.

During the tests on the 1973 Ford LTD, carbon deposits were observed to occur within 1,000 miles of operation of the car without treatment of the combustion air. These plugs were removed and replaced with new ones that were operated for 1,000 miles with comparable driving of the car utilizing the UV radiation of the combustion air. The plugs were then removed and upon examination were found free of fouling carbon buildup. In an engine in an otherwise sound condition, fouling is due to incomplete combustion of a rich air-fuel mixture, and spark plugs that remain clean indicate an efficient combustion of the air-fuel mixture. The interaction of combustion, the degree of polluting emissions, and the degree of carbon deposit on the spark plugs is well known and is described in the Staff Report, Committee on Commerce, the U.S. Senate, entitled "The Search for a Low-Emission Vehicle," U.S. Government Printing Office, Washington, D. C.

EXAMPLE II

The invention was also tested on a smaller car, namely a 1971 Ford Pinto sedan with automatic transmission and a 2000 cubic centimeter four cylinder engine, equipped as shown in FIGS. 1 and 2 with two eight-watt General Electric G8T5 UV tubes.

The engine was equipped with new spark plugs, points, and air filter and tuned up to maximum performance according to the manufacturer's recommendations. Six separate controlled road tests totalling 780 miles were conducted in the manner previously described, to determine the miles per gallon of regular gasoline that was obtained without treatment of the combustion air in accordance with the invention. This resulted in a base line average of 20.0 miles per gallon. Six similar controlled road tests totalling 616 miles, with the ultraviolet radiation operating, resulted in a significant gain in fuel economy with an average of 36.2 miles per gallon.

Thereafter, the car was operated in uncontrolled experimental use for an additional 3343 miles with the air being treated. This resulted in an average of 30.7 miles per gallon. During this uncontrolled use, different persons drove the Pinto and no set courses were followed.

EXAMPLE III

Olfaction tests of exhaust fumes from the cars tested indicated a marked reduction of unburned hydrocarbons in the exhaust when the combustion air was treated to activate the oxygen.

Practically all hydrocarbons found in gasoline are paraffins, olefins, naphthenes or aromatics.

It is well known that incomplete combustion results in discharge of unburned gasoline and other products in the automobile exhausts such as alcohols, aldehydes, ketones, phenols, acids, esters, ethers, epoxides, peroxides and other oxygenates. Some of these have characteristic aromatic odors such as the alcohols, ketones, and ethers that can be detected in a semi-quantitative way by the smell of the exhaust fumes. This phenomena was utilized in an initial test of the effect of the output of unburned hydrocarbons in the exhaust with the engine operating with and without the combustion air being subjected to ultraviolet radiation. Tests were conducted on the car of Example I in a small tightly enclosed garage. The car was operated until the engine was warmed up and the carburetor choke opened. It was then taken into the garage, the garage door closed, and allowed to idle for three minutes and shut off. The accumulated exhaust fumes were then smelled for comparison with those accumulated when the procedure was repeated with ultraviolet radiation of the combustion air. Prior to making the comparison, the garage door was opened and the garage permitted to air out. Thereafter, the test was repeated with the combustion air being subjected to UV radiation. Three different observers agreed that in the latter case, no raw gasoline odor was detected and the odor of aromatic hydrocarbons was greatly decreased.

EXAMPLE IV

Use of the invention has also resulted in diminished carbon monoxide in the engine exhaust. The ideal end products of complete combustion of fossil fuels given off into the atmosphere, or the exhaust from an internal combustion engine are carbon dioxide and water vapor. However, where less than ideal conditions for combustion occur, a major pollutant that is highly toxic occurs in the form of carbon monoxide. Carbon monoxide is formed as an intermediate product of reactions between carbonaceous fuel and oxygen when less than the necessary amount of oxygen required for complete combustion is supplied or when exhaust temperatures are excessively high so as to cause the secondary breakdown of carbon dioxide before it is emitted from the exhaust system of an automobile. Because such conditions exist in the cylinders of the diesel and gasoline internal combustion engines and because of the large number of such engines in vehicles, carbon monoxide emissions from these sources conspicuously exceed those from any combination of other sources. The activation or excitation of the oxygen produces more complete combustion with lower ignition temperature and burning temperature favorable for the oxidation-reduction reaction to go farther to completion without the formation of undesirable carbon monoxide emissions. This was demonstrated by testing the exhaust gases from the car used in Example I with and without activation or the oxygen. A Drager multi-gas detector Model 21/31 was utilized according to accepted scientific procedures for use in detecting atmospheric pollutants. Six samples of exhaust gas were collected while the engine of the car used in Example I was operating at idle speed and while accelerating without activation of the oxygen, and six samples were taken under the same conditions while the oxygen was activated. All exhaust gas samples after a 5:1 dilution were analyzed for percentage of carbon monoxide and the following results obtained without activation:

Six samples of the exhaust with untreated combustion air averaged 0.20% concentration of carbon monoxide whereas the average of samples with the oxygen activated by ultraviolet radiation was 0.115%, thus representing approximately 50% reduction in the carbon monoxide emissions.

To confirm the reduction of unburned hydrocarbons in the exhaust samples with and without use of the invention, exhaust samples were tested. Without activation of the oxygen an average of 1.4% of the exhaust was unburned hydrocarbons. However, with the combustion air treated, unburned hydrocarbons in the exhaust were found to be only 0.21%.

In the foregoing Examples, the UV lamps were energized at primarily 2300 Hz, not considering harmonics. Beneficial results have also been obtained at various intervals in the range of 1000–30,000 Hz. As presently known, a frequency range of 150–30,000 Hz may be utilized.

It may thus be seen that the objects of the invention set forth as well as those made apparent from the foregoing description are efficiently attained. While preferred embodiments of the invention have been set forth for purposes of disclosure, modification to the disclosed embodiments of the invention as well as other embodiments thereof may occur to those skilled in the art. Accordingly, the appended claims are intended to cover all embodiments which do not depart from the spirit and scope of the invention.

What is claimed is:

1. A method of treating combustion air for an internal combustion engine having means defining an air intake chamber, comprising the steps of subjecting air in said air intake chamber prior to mixture with fuel to radiation of ultraviolet light at a wavelength of substantially 2537 A° to treat the oxygen molecules prior to mixing the air with fuel.

2. The method of claim 1 where the engine further includes a carburetor and air cleaner and the air passes through the air cleaner to the carburetor and said chamber is the air cleaner housing, said light source being positioned in said air cleaner so that air is subjected to radiation from said source as it enters the carburetor.

3. The method of claim 1 where said ultraviolet light is produced by an ultraviolet lamp energized by an electrical potential at a frequency of 150–30,000 Hertz.

4. In combination with an automobile having an electrical system, an internal combustion engine and an air intake for said engine, an inverter connected to said electrical system and adapted to supply an alternating potential, a source of ultraviolet light disposed in the air intake prior to a point of combination of the intake air with fuel, and means connecting said inverter to said source of ultraviolet light whereby the light source may be energized by said inverter, said source providing light substantially at a wavelength of 2537 A°.

5. The combination of claim 4 further including a carburetor, an air cleaner housing disposed above the carburetor and having an opening in communication with a barrel of the carburetor, said source of ultraviolet light being positioned in said air cleaner housing so that the air entering the barrel is subjected to radiation from said source.

6. The combination of claim 4 further including reflective means disposed within the air cleaner adapted to reflect the ultraviolet radiation toward said barrel.

7. The combination of claim 6 where said air intake comprises an air cleaner housing disposed above the carburetor of the engine, said air cleaner housing including an extending air scoop, and a source of ultraviolet light disposed in said air scoop.

8. In combination with an internal combustion engine having a combustion air intake housing, a source of ultraviolet light disposed in said housing and positioned to radiate the incoming combustion air prior to the air mixing with fuel, said source of ultraviolet light radiating at a wavelength of substantially 2537 A°.

9. The combination of claim 7 where the ultraviolet source is energized by an electric potential at a frequency of 150–30,000 Hertz.

* * * * *

UNITED STATES PATENT AND TRADEMARK OFFICE

CERTIFICATE OF CORRECTION

PATENT NO. : 4,195,606

DATED : April 1, 1980

INVENTOR(S) : THOMAS F. WALLIS, JR. ET AL

It is certified that error appears in the above-identified patent and that said Letters Patent are hereby corrected as shown below:

Column 3, line 40, "$O^{-}$" should read -- $O^{--}$ --.

Column 8, line 1 of claim 7, "claim 6" should read --claim 4--.

Signed and Sealed this

Tenth Day of June 1980

[SEAL]

Attest:

SIDNEY A. DIAMOND

Attesting Officer

Commissioner of Patents and Trademarks